United States Patent [19]

Maruyama et al.

[11] Patent Number: 4,603,271

[45] Date of Patent: Jul. 29, 1986

[54] FAN MOTOR

[75] Inventors: Kunihiko Maruyama, Hino; Satoshi Nakamura; Katsumi Sato, both of Tokyo, all of Japan

[73] Assignee: Nippon Keiki Works, Ltd.

[21] Appl. No.: 765,544

[22] Filed: Aug. 14, 1985

[30] Foreign Application Priority Data

Aug. 21, 1984 [JP] Japan ..... 59-125946

[51] Int. Cl.[4] ..... H02K 9/00

[52] U.S. Cl. ..... 310/62; 310/63; 310/42; 310/43; 310/268

[58] Field of Search ..... 310/62, 89, 63, 64, 310/42, 65, 43, 58, 156, 59, 268, 254, 40.5, 261, 157; 29/596, 598; 415/212 A, 213 C

[56] References Cited

U.S. PATENT DOCUMENTS 3,961,864 6/1976 Papst et al. ..... 310/63
4,164,690 8/1979 Muller et al. ..... 310/63
4,360,751 11/1982 Arnold et al. ..... 310/63

FOREIGN PATENT DOCUMENTS 2394199 2/1979 France ..... 310/63
1210141 10/1970 United Kingdom ..... 310/40.5

*Primary Examiner*—R. Skudy
*Attorney, Agent, or Firm*—Spencer & Frank

[57] ABSTRACT

The fan motor according to this invention is made of a base plate in the form of almost square plate. At a center of the base is provided a large enough opening. Within the central opening are mounted radially extending fixed blades, and at a center of the fixed blades a stator of the electric motor is fixed. On the other hand, to a rotor of the motor movable blades are fixed, so that the movable blades face the fixed blades. In this structure, the fixed blades serve also as holding or supporting members for the motor, and increases the airflow as well as the efficiency of the fan motor. Since the base and the fixed blades are made integral with each other by molding synthetic resin material, the number of parts as well as the assembly processes can much be reduced, thus enabling to reduce the manufacturing cost.

4 Claims, 8 Drawing Figures

FAN MOTOR

BACKGROUND OF THE INVENTION

This invention relates to a fan motor for cooling purpose, and more particularly to the fan motor to be mounted on small electronic appliances, such as personal computers and telecopiers.

In such a conventional fan motor a fan is directly mounted on a motor axle, the motor being disposed at a center of the mounting base body and supported with several supporting members extended in the traversing directions of the blades of the fan. If desired, the fan portion is further covered with a so-called finger guard for example made of a metal net gauge. By the existence of such supporting members and the metal gauge, the airflow of the fan becomes weaker and therefore the cooling efficiency of the fan motor is reduced. Moreover, such a conventional structure requires a large number of parts and necessitates a complicated assembling. As the result, the manufacturing cost has relatively been high.

An object of this invention is therefore to provide a fan motor of higher cooling efficiency and which can easily be assembled, thus overcoming all the mentioned drawbacks of the conventional fan motors.

SUMMARY OF THE INVENTION

The fan motor according to this invention is made of a base body in the form of almost square plate. A mounting opening is provided at each of the corners of the square base body, while at a center of the base is provided a large enough opening. Within the central opening are mounted radially extending fixed blades, and at a center of the fixed blades a stator of the electric motor is fixed. On the other hand, movable blades are fixed to a rotor of the motor, so that the movable blades face the fixed blades. In this structure, the fixed blades serve also as holding or supporting members for the motor, thus increasing the airflow as well as the efficiency of the fan motor. Since the base and the fixed blades are made integral with each other by molding synthetic resin material, the number of parts as well as the assembly processes can much be reduced, thus enabling to reduce the manufacturing cost.

Further, the motor is held with many fixed blades, thus increasing the durability of the fan motor. Not only the above features, the fixed blades serve as the finger guard of the motor, thus eliminating the necessity of providing any further safety means.

If finger guards are required to both sides of the movable blades, the following structure may be used:

The base body is made with two divisions transversely cut or separated with respect to the axis of the base body. All the above mentioned parts are mounted to one of the divided base bodies, while fixing a further set of fixed blades on the other divided base body. The divided base bodies are assembled at the time when a fan motor is mounted to an appliance and fixed with the same fixing screws. The structure of this double fixed blade system is relatively simple but also can further increase the airflow.

PREFERRED EMBODIMENTS

Figure 1:
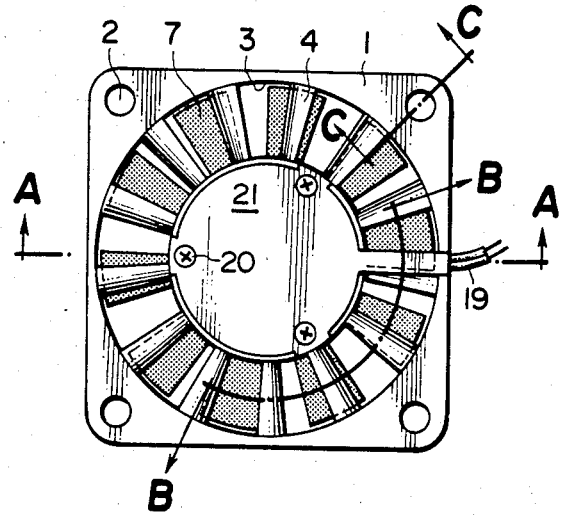
FIG. 1 is a front view of a first embodiment of the fan motor according to the present invention.

FIGS. 1 through 4 show the first embodiment of the fan motor according to this invention.

A base body 1 in the form of an almost square plate is made of synthetic resin material and has four mounting openings 2 at the four corners thereof, through which fixing screws are mounted. In the center of the base plate 1 is formed a sufficiently large opening 3. Within the circular opening 3 are fixed radially mounted fixed blades 4 which are integrally molded with the base plate 1. On the other hand, the fixed blades 4 support and hold a stator 5 of an electric motor disposed in a center of the circular opening 3. Rotatably supported to the stator 5 is a rotor 6 of the motor. Around the rotor 6 movable blades 7, indicated in FIG. 1 with crossing lines, are radially mounted faced with the fixed blades 4. The movable blades 7 have an opposite angle of stagger with respect to the fixed blades 4.

The stator 5 is made of a circular yoke 10, whose peripheral edge is held with the fixed blades 4, and is fixed to a plurality of coils 11 each disposed in a ring form and a printed circuit plate 12 for changing over circuits of the coils 11. In a center of the yoke 10 is fixed a bearing 13.

Figure 2:
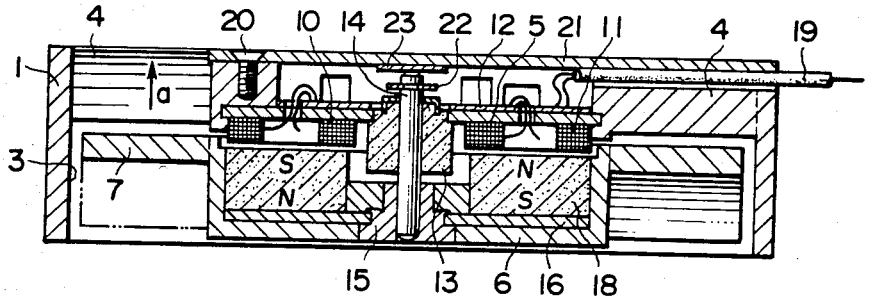
FIG. 2 is an A—A section of the fan motor shown in FIG. 1.

The rotor 6 comprises a circular yoke 16, a base of synthetic resin, the circular yoke 16 and the base being mounted on a supporting metal fitting 15 fixed at one end of an axle 14, and a plurality of magnets 18 disposed in a ring on the yoke 16, the magnets having polarities N, S, as indicated in FIG. 2. The movable blades 7 are at the periphery of the base and are molded integrally therewith.

Wires 19 of the printed circuit plate 12 are guided to outside of the fan motor along one of the fixed blades 4. On the other hand, the printed circuit plate 12 is covered with a cover plate 21 by means of a screw 20.

In assembling, the axle 14 of the rotor 6 is inserted into the bearing 13 and then a clip 22 is mounted around the axle 14. When the cover plate 21 is then covered, the axle 14 pressedly contacts to a thrust bearing 23, attached to the cover plate, by the absorbing force of the magnets 18 and the yoke 10. Thus the rotor 6 is held keeping a small gap between the magnets 18 and the coils 11. The assembled fan motor may be mounted to the desired place of an appliance with screws fitted through the openings 2.

FIGS. 5–8 show the second embodiment of the fan motor according to this invention.

In the explanation of these figures relating to the second embodiment, the same reference numbers as FIGS. 1–4 represent the same or similar elements as those of the first embodiment of this inveniton.

In the fan motor of the second embodiment, the base plate consists of two separate divisions 1 and 8 cut with a perpendicular plane with respect to the axis line of the circular opening 3, or in other words the axle of the above rotor. A set of fixed blades 4 are fixed on one of the division plates, and on the other hand, within the circular opening 3 of the other division plate 8 are provided integrally therewith and radially another set of fixed blades 9. Then the sets of fixed blades 4 and 9 are disposed in front and at the back of the movable blades 7.

Before assembling the base plate 8, the base plate 1 is finished as explained with reference to the first embodiment. Then the base plate 8 and the above finished plate 1 are assembled together and may be mounted to the desired place of an appliance with screws fixed through.

If the fan motor is to be mounted to the housing of an electronic appliances, any inner side finger guard is not required. In such a case, the base 8 with the blades 9 may be dispensed with, thus reducing the thickness of the fan motor.

Figure 3:
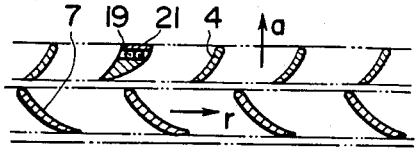
FIG. 3 is a B—B section of the fan motor shown in FIG. 1.
Figure 4:
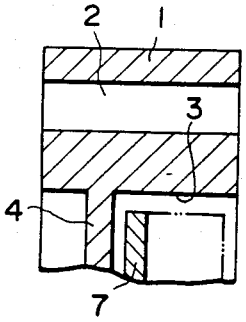
FIG. 4 is a C—C section of FIG. 1.
Figure 5:
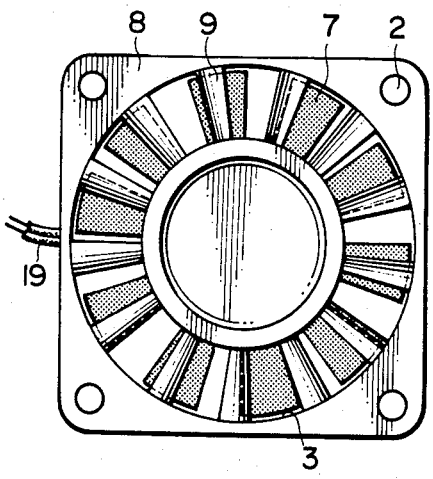
FIG. 5 is a rear view of a second embodiment of the fan motor according to the present invention.
Figure 6:
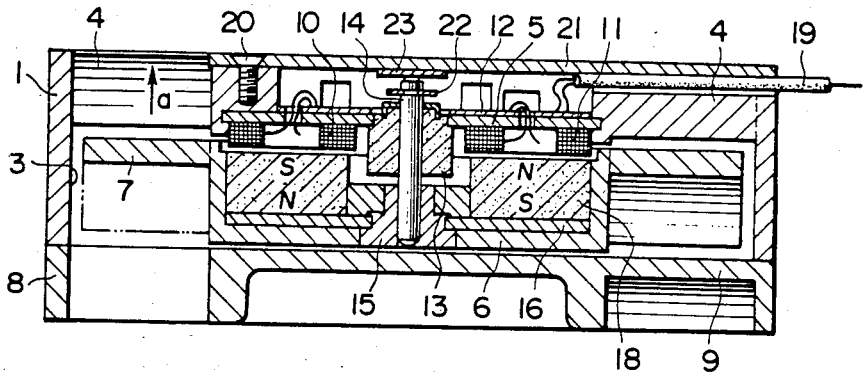
FIG. 6 is an A—A section of the fan motor shown in FIG. 5.
Figure 7:
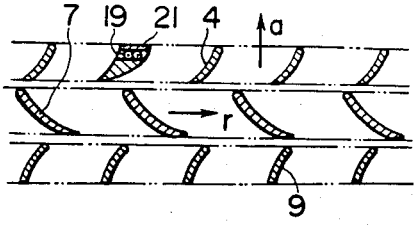
FIG. 7 is a B—B section of the fan motor shown in FIG. 5.
Figure 8:
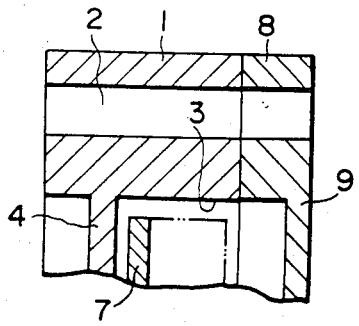
FIG. 8 is a C—C section of FIG. 5.

As shown in FIGS. 3 and 7, the movable blades 7 rotate in the direction shown by an arrow r in the figures, resulting in the generation of an air stream as shown by an arrow a. It will be understood that by the existence of the fixed blades 4 and 9 the airflow could be increased. Since the supporting members for holding the electric motor as well as the finger guard may now be dispensed with by such a structure as the embodiments of this invention, reduction of airflow by these means does not occur, thus assuring a high efficiency of the motor. As fully explained, the structure of the fan motor according to this invention is very simple, thus enabling easy manufacturing, assembling and mounting to any desired appliances.

What is claimed is:

1. A fan motor for cooling purpose comprising:

a base plate of almost square form having a central opening and fitting openings at corners of the base plate;

a stator of the motor, the stator being disposed at a center of the central opening;

fixed blades radially provided around the stator at an inner side of the central opening, the fixed blades holding the stator of the motor;

a rotor of the motor rotatably mounted to the stator; and movable blades radially provided around the rotor facing the fixed blades, the movable blades having an opposite angle of stagger with respect to the fixed blades.

2. A fan motor according to claim 1, wherein the base plate and the fixed blades are made integral by molding of synthetic resin material.

3. A fan motor according to claim 1, further comprising a second base plate of almost square form having a central opening and corner fitting openings corresponding to the central opening and fitting openings of the base plate; and second fixed blades radially provided at an inner side of the central opening of the second base plate, the second base plate being assembled with the base plate provided with the stator, the fixed blades, the rotor and the movable blades, so that the second fixed blades stand at a reverse side of the fixed blades with respect to the movable blades.

4. A fan motor according to claim 3, wherein the second base plate and the second fixed blades are made integral by molding of synthetic resin material.

* * * * *